United States Patent [19]

Rhea

[11] Patent Number: 4,470,174

[45] Date of Patent: Sep. 11, 1984

[54] ADJUSTABLE FASTENER

[76] Inventor: Don E. Rhea, 201 Wilson Ave., Placentia, Calif. 92670

[21] Appl. No.: 448,773

[22] Filed: Dec. 10, 1982

[51] Int. Cl.[3] ..... A44B 11/00; B65D 63/00

[52] U.S. Cl. ..... 24/68 E; 24/16 PB; 24/17 AP; 24/174; 24/265 WS

[58] Field of Search ..... 24/68 R, 68 E, 165, 24/174, 180, 185, 302, 499, 516, 16 PB, 17 AP, 30.5 P, 265 WS, 69 SK

[56] References Cited

U.S. PATENT DOCUMENTS

| | | | |
|---|---|---|---|
| 137,000 | 3/1873 | Hunt | 24/17 AP |
| 223,043 | 12/1879 | Hamilton, Jr. | 24/180 |
| 482,289 | 9/1892 | Ziegler | 24/180 |
| 505,473 | 9/1893 | Mehring | 24/174 |
| 896,261 | 8/1908 | Ziegler | 24/174 |
| 1,047,398 | 12/1912 | Farrington | 24/69 SK |
| 1,701,060 | 2/1929 | Armbrust | 24/265 WS |
| 1,742,464 | 1/1930 | Eklund | 24/265 WS |
| 2,359,148 | 9/1944 | Partridge | 24/17 AP |
| 3,046,056 | 7/1962 | Greene et al. | 24/165 |
| 3,155,987 | 11/1964 | McGill | 24/16 PB |
| 3,322,325 | 5/1967 | Bush | 24/30.5 P |
| 3,562,870 | 2/1971 | Sund | 24/16 PB |
| 3,748,700 | 7/1973 | Willey | 24/174 |
| 4,288,892 | 9/1981 | Mardirossian | 24/265 WS |

FOREIGN PATENT DOCUMENTS

| | | | |
|---|---|---|---|
| 847682 | 10/1939 | France | 24/174 |
| 1064464 | 5/1954 | France | 24/16 PB |
| 785221 | 10/1957 | United Kingdom | 24/174 |
| 873304 | 7/1961 | United Kingdom | 24/302 |

*Primary Examiner*—Victor N. Sakran

*Attorney, Agent, or Firm*—Lawrence D. Sassone

[57] ABSTRACT

An adjustable fastener comprising a strap having a first portion and a second portion and a plurality of holes in the first portion of the strap and a yoke having a hook portion and a clasp portion and a hole adjustably coupled to the first portion of the strap and engagement means coupled to the second portion of the strap capable of engaging the yoke and disengaging from the yoke.

3 Claims, 23 Drawing Figures

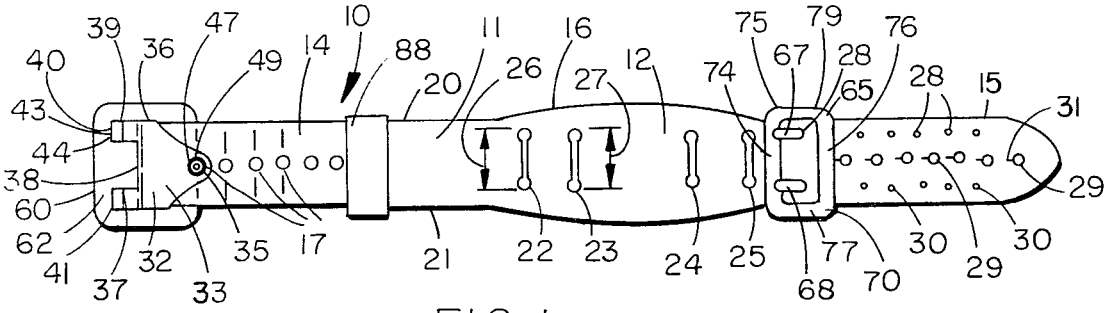
FIG. 1
FIG. 4
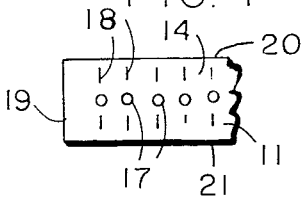
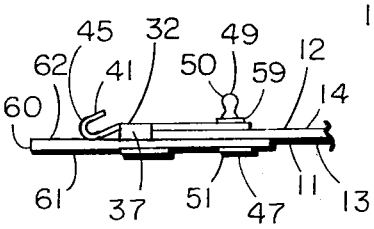
FIG. 5
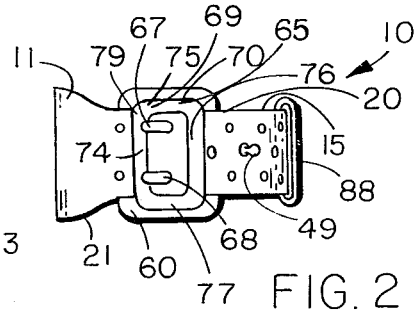
FIG. 2
FIG. 6
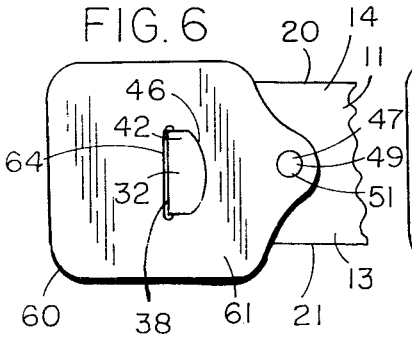
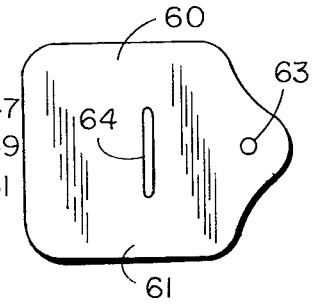
FIG. 7
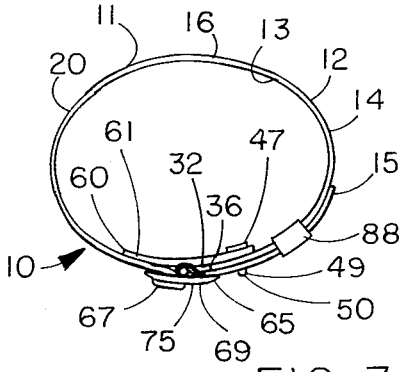
FIG. 3
FIG. 8
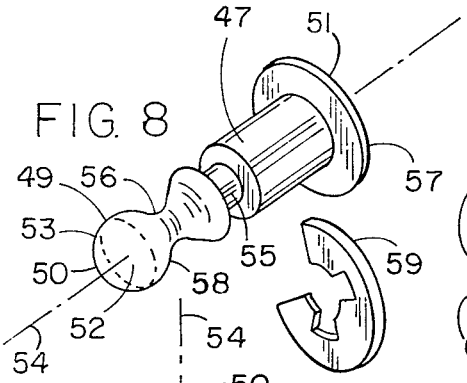
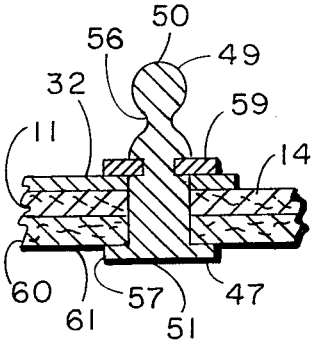
FIG. 10
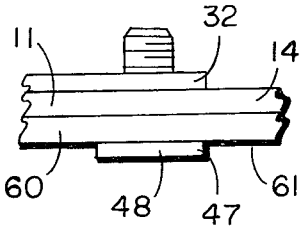
FIG. 11
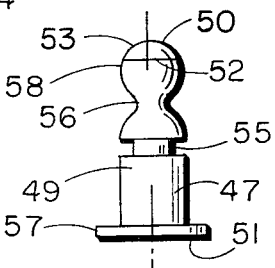
FIG. 9
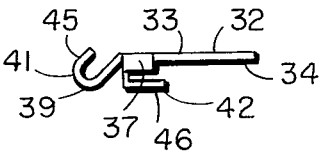
FIG. 12
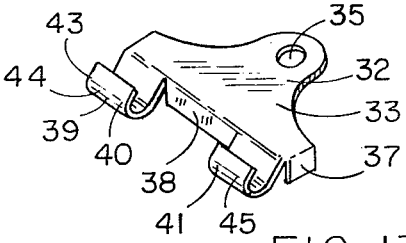
FIG. 13

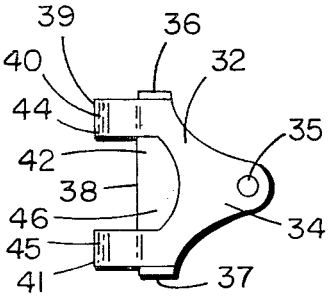
FIG. 14
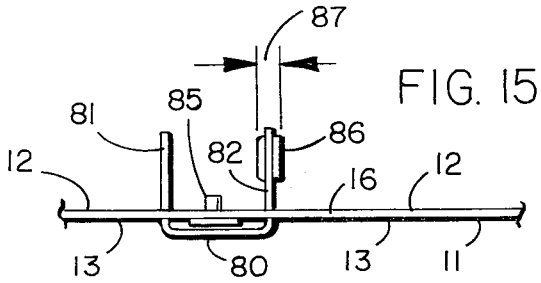
FIG. 15
FIG. 16
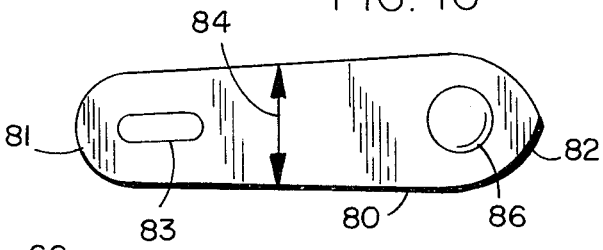
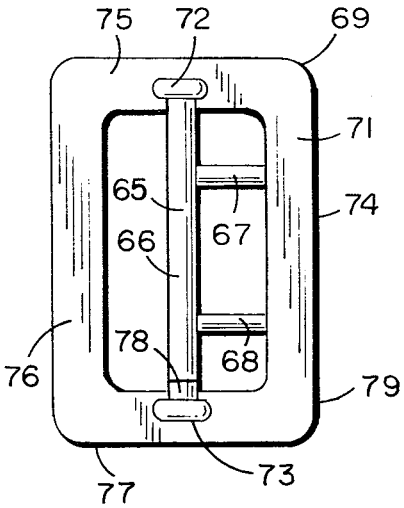
FIG. 17
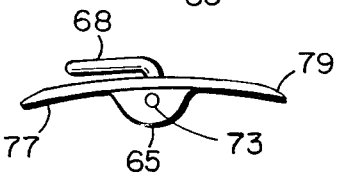
FIG. 18
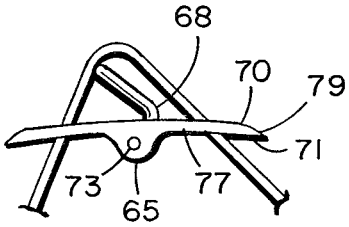
FIG. 19
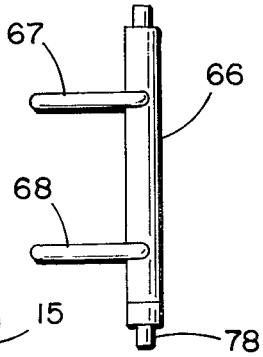
FIG. 21
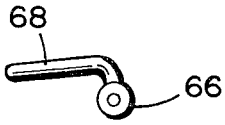
FIG. 22
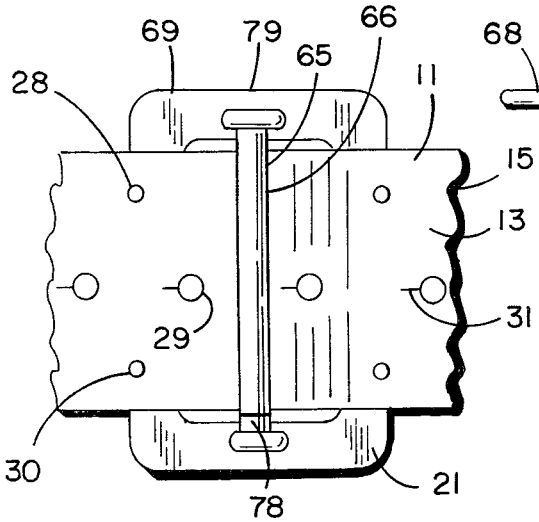
FIG. 20
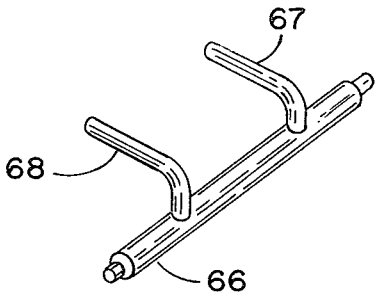
FIG. 23

ADJUSTABLE FASTENER

BACKGROUND OF THE INVENTION

Belts are worn by people on their pants and on dresses and on their coats, among other clothing. Watch bands are worn by people primarily on their wrist. The present invention is an adjustable fastener that has applications similar to the uses of a belt and a watch band and other uses where an adjustable fastener may be employed.

The prior art in belts requires that a belt be made for one size only such as for a 32 inch waist or a 34 inch waist and generally can accommodate a waist only within a few inches of the designated size for the belt. Most belts merely have holes in the first portion of the belt and a buckle in the second portion of the belt wherein the first portion of the belt is inserted into the buckle and connected thereto as is commonly known. Belts used by police officers and other peace officers and law enforcement officers commonly use a belt that is known as the Sam Browne belt. The Sam Browne belt is the closest art in the prior art to the invention herein. The buckle of the Sam Browne belt is similar to the buckle used in the invention herein in that the buckle is removeable from the second portion of the Sam Browne belt and comprises a bar, a frame and two hooks that are installed in two holes in an upper and lower row on the Sam Browne belt. The Sam Browne belt also has a middle row of holes in the second portion of the belt similar to the invention herein with cuts at the holes. The length of the Sam Browne belt may be adjusted by moving the buckle along the strap to a different set of holes. However, if the Sam Browne belt is too big for the person using it the Sam Browne belt may be made to fit a smaller person by moving the buckle towards the middle of the Sam Browne belt which results in an unduly and unsightly long portion of the tongue of the Sam Browne belt extending outward from the person. The bar in the buckle of the Sam Browne belt is attached to two hooks in the first portion of the Sam Browne belt. Because of this the Sam Browne belt is very limited in its adjustment, for example, a 34 inch Sam Browne belt may be adjusted to accommodate a maximum size of 36 inches and a minimum size of 32 inches. By contrast, the invention herein may be adjusted to virtually any size.

The two hooks at the buckle in the Sam Browne belt are connected by a straight flat piece of metal and this piece of metal is connected to the first portion of the Sam Browne belt by wrapping the end of the first portion of the Sam Browne belt around the flat piece of metal that connects the two hooks and then riveting the wrapped around portion of the belt to the portion of the belt just prior to it being wrapped around and then, in addition sewing the two pieces together. Thus the hooks that engage the buckle are firmly attached in the Sam Browne belt and are not adjustable at all. A pad is placed behind the hooks in the Sam Browne belt and a short metal bar having a spherical top is connected to the first portion of the Sam Browne belt for the purpose of inserting the spherical portion into a hole in the middle row of the second portion of the Sam Browne belt to help keep the end of the second portion of the Sam Browne belt close towards the first portion of the Sam Browne belt and prevent it from sticking out further than it otherwise would. This spherical ball resembles the stud used in the invention herein except that the spherical ball is not removeable and does not use a lock retainer and does not have a recess for lock retainer. With the exception of the foregoing there are no other similarities between the Sam Browne belt and the invention herein.

There are belts that are adjustable and are made similar to suspenders. Such belts are not suitable for police officers or members of law enforcement because police officers put a large amount of heavy equipment on their belts and a rather wide and thick and strong belt is required to support such equipment which suspender type belts will not do.

Wrist watch bands in the prior art are made similar to conventional belts and like the Sam Browne belt and suffer from the same disadvantages as the prior art belts. These type of prior art watch bands are usually made with a strap and have a buckle similar to the prior art belts previously discussed. These type of watch bands have the same disadvantages as the prior art belts in that their adjustment is very limited. Other types of watch bands are made of metal and are expandable such as the commonly known Speidel watch band. The metal type watch bands require the removal or insertion of links in order to adjust the size of the watch band.

Lock retainers, also known as rings have existed in the prior art for some time and may be purchased at the appropriate store. However, no known prior art uses a lock retainer on a belt or watch band or similar fastener. Snaps have been used in the prior art for some time, for example, to snap blue jeans together at the waist and to snap together other articles of clothing such as shirts and coats. However, the snap in the invention herein is used in a unique manner to not only snap the watch in place but also to secure the watch to the strap in the event that the snap becomes unsnapped in the embodiment used as a watch band. No known prior art accomplishes this.

Spring bars have been known in the prior art for some time and are used, for example, on watches where the band is attached to the watch. The prior art spring bar is typically shaped like a cylindrical rod having a very small diameter in which the top portion of the rod has a spring between it and the bottom portion of the rod so that the top portion of the rod can be moved down over the bottom portion of the rod and then will return to its original position by the spring inside. The same technique is used with the bar in the buckle of the invention herein to make the bar easily removeable from the frame of the buckle. None of the known prior art uses a spring bar on a belt or a watch band or any other similar fastener.

None of the prior art suggests or uses a removeable or adjustable yoke like in the invention herein. None of the known prior art suggests or uses a removeable stud like the stud in the invention herein. As such the invention herein is unique and novel.

It is unknown whether the Sam Browne belt has ever been patented and it is unknown whether there are any written materials describing it. It is unknown whether or not there are any patents in the prior art in the field that the invention herein is in and it is unknown whether there are any written materials describing the prior art.

SUMMARY OF THE INVENTION

The present invention relates to an adjustable fastener that may be used as a wrist watch band or as a belt for the pants of a person, among other uses. One object of the invention was to make an adjustable fastener of one size that could be easily and quickly adjusted to a variety of other sizes. Another object of the invention was to make an adjustable fastener that was adjustable at two different positions on the adjustable fastener. Another object of the invention was to provide means to avoid losing a watch in the embodiment where the adjustable fastener is used as a wrist watch band. Another object of the invention was to eliminate a large portion of the strap from protruding out from the keeper.

The present invention in one embodiment comprises a strap having a first portion and a second portion and a plurality of holes in the first portion of the strap and a yoke adjustably coupled to the first portion of the strap and an engagement means coupled to the second portion of the strap capable of engaging the yoke and disengaging from the yoke.

In another embodiment the invention comprises a strap having a second portion and a first portion having a plurality of holes in a row in the first portion of the strap and having an approximately straight first end, top and bottom in the first portion of the strap wherein the first end of the strap is approximately perpendicular to the top and the bottom of the strap and a yoke having a hole adjustably coupled to the first portion of the strap and having a hook portion of the yoke that is shaped like a hook and having a clasp portion of the yoke that is shaped like a clasp and having a top lip coupled to the top of the strap and a bottom lip coupled to the bottom of the strap and a side lip coupled to the first end of the first portion of the strap and a stud having an axis and the stud is disposed about the axis of the stud and having an upper portion that has a curved surface and having a top and a bottom and a lip at the bottom of the stud and having a recess and a pad having a hole and a slot wherein the clasp portion of the yoke is inserted in the slot of the pad and the stud is inserted in the hole of the pad and the hole of the strap and the hole of the yoke and a lock retainer is coupled to the recess of the stud and a bar is coupled to the second portion of the strap.

In one embodiment the engagement means is a bar and in another embodiment the engagement means is a buckle.

In another embodiment the strap has a plurality of holes in an upper row and a plurality of holes in a lower row in the second portion of the strap and further comprises an upper hook coupled to the bar and removeably inserted in a hole in the upper row of the second portion of the strap and a lower hook coupled to the bar and removeably inserted in a hole in the lower row of the second portion of the strap.

In another embodiment the strap has a first slot having a height and a second slot and further comprises a pliable band having a hole and a varying height and a first portion of a snap coupled to the strap and a second portion of a snap coupled to the band wherein the band is inserted in the first slot of the strap and the second slot of the strap so that the height of the band in the first slot is greater than the height of the first slot.

In another embodiment the removeable fastening means is a stud wherein the cross section of the stud decreases towards the top of the stud.

BRIEF DESCRIPTION OF THE DRAWINGS

FIG. 1 is a front side view of the adjustable fastener.

FIG. 2 is a view of the front side of the adjustable fastener with the first portion of the strap connected to the second portion of the strap in the same manner that the adjustable fastener might appear when connected together on the wrist of a person or on the pants of a person.

FIG. 3 is a top view of the embodiment shown in FIG. 2.

FIG. 4 is a fragmentary view of the embodiment shown in FIG. 1 with the yoke and pad and stud removed illustrating the straight first end, top and bottom of the first portion of the strap.

FIG. 5 is a fragmentary bottom view of the embodiment shown in FIG. 1 showing in detail how the yoke, pad and stud are coupled together.

FIG. 6 is a fragmentary view of the embodiment shown in FIG. 1 and FIG. 5 of the back side of the pad and back side of the strap showing the clasp portion of the yoke and the slot of the pad and the bottom of the stud.

FIG. 7 is the same view as the embodiment shown in FIG. 6 but with the yoke, stud and strap removed and illustrates only the pad from the back side.

FIG. 8 is a top perspective view of the stud and the lock retainer showing the lock retainer removed from the stud.

FIG. 9 is a side view of the embodiment of the stud shown in FIG. 8.

FIG. 10 is a fragmentary cross section view showing how the stud is installed. FIG. 11 is a fragmentary view similar to the view of FIG. 10 except that it is not a cross section view and the embodiment using a screw is used instead of a stud. FIG. 12 is a bottom view of the yoke. FIG. 13 is a front perspective view of the yoke. FIG. 14 is a view of the back side of the yoke. FIG. 15 is a fragmentary bottom view showing how the band is coupled to the strap. FIG. 16 is a view of the front side of the band. FIG. 17 is a view of the back side of the frame and the bar and the upper hook and lower hook of the bar. FIG. 18 is a bottom view of the embodiment shown in FIG. 17. FIG. 19 is the same embodiment shown in FIG. 18 except a fragmentary view of the strap is included to show how the strap is installed. FIG. 20 is the same embodiment shown in FIG. 17 except that a fragmentary portion of the strap is also shown in the buckle. FIG. 21 is a front view of the bar orientated in the same manner as shown in FIG. 1. FIG. 22 is a bottom view of the embodiment shown in FIG. 21 except that the spring bar is omitted. FIG. 23 is a front perspective view of the embodiment shown in FIG. 22.

DETAILED DESCRIPTION

Reference is now made to the accompanying drawings for a better understanding of the invention wherein all the parts are numbered.

In the embodiment shown in FIGS. 1, 2 and 3 an adjustable fastener 10 comprising a strap 11 having a first portion 14 and a second portion 15 and a plurality of holes 17 in the first portion 14 of the strap 11 and a yoke 32 adjustably coupled to the first portion 14 of the strap 11 and engagement means 65 coupled to the second portion 15 of the strap 11 capable of engaging the yoke 32 and disengaging from the yoke 32. The engagement means 65 may be a bar 66 or a buckle 79 as shown in FIGS. 1, 2, 3 and 17 through 23.

In one embodiment of the invention the strap 11 has a plurality of holes 28 in an upper row and a plurality of holes 30 in a lower row in the second portion 15 of the strap 11 and an upper hook 67 coupled to the bar 66 and removeably inserted in a hole 28 in the upper row of the second portion 15 of the strap 11 and a lower hook 68 coupled to the bar 66 and removeably inserted in a hole 30 in the lower row of the second portion 15 of the strap 11 as shown in FIG. 1, 2, 3 and 17 through 23. The holes 28 in the upper row and the holes 30 in the lower row are approximately one above the other as shown in FIG. 1, 2 and 20. The upper hook 67 and the lower hook 68 that are coupled to the bar 66 face toward the first portion 14 of the strap 11 so that when the first portion 14 of the strap 11 is coupled to the second portion 15 of the strap 11 any force tending to separate the first portion 14 of the strap and the second portion 15 of the strap will be resisted. The hooks 67 and 68 are shown pointing toward the first portion 14 of the strap 11 in FIG. 1. The upper hook 67 and the lower hook 68 should be approximately of the same size and shape as shown in FIG. 21, 22 and 23. This will permit the hooks 67 and 68 to be inserted in holes 28 and 30 that are one above the other. In a preferred embodiment the hooks 67 and 68 and the bar 66 are all one piece and it is preferred that they be made from metal or any other material of suitable strength. If they are made from metal the hooks 67 and 68 and the bar may be made by hand or by a molding process or other conventional means. The bar 66 may be coupled to the second portion 15 of the strap 11 by sewing it to the strap 11 or by the use of adhesives or other conventional means or by using a frame 69 as set forth hereinafter.

In the embodiment shown in FIGS. 1, 2, 3, 17, 18, 19 and 20 the adjustable fastener 10 further comprises a frame 69 having an upper hole 72 and a lower hole 73 wherein the bar 66 is coupled to the frame 69 at the upper hole 72 of the frame 69 and the lower hole 73 of the frame 69 and the second portion 15 of the strap 11 is positioned between the bar 66 and the frame 69. The frame 69 has a front side 70, a back side 71 and a first side 74, a second side 75, a third side 76 and a fourth side 77. In the embodiments shown in FIGS. 1, 2, 3, 17, 18, 19 and 20 the frame 69 has a rectangular shape and the first side 74 is approximately perpendicular to the second side 75 and to the fourth side 77 and the third side 76 is approximately perpendicular to the second side 75 and the fourth side 77 of the frame 69. The bar 66 is coupled to the frame 69 by inserting the bar in the upper hole 72 of the frame 69 and in the lower hole 73 of the frame 69. The bar 66 is rotatable in the holes 72 and 73 of the frame 69 so that the frame 69 and bar 66 may be removed from the strap 11. The strap is installed in the frame 69 as shown in FIG. 19 by inserting the second portion 15 of the strap 11 first between the first side 74 of the frame 69 then bringing the strap 11 over the hooks 67 and 68 and then down under the third side 76 of the frame as shown in FIG. 19. The hooks 67 and 68 are then inserted in a hole 28 in an upper row in the second portion 15 of the strap 11 and in a hole 30 in the lower row of the second portion 15 of the strap 11. The determination of which holes 28 and 30 that the hooks 67 and 68 will be inserted in will depend on the size of the object that the adjustable fastener 10 will be attached to.

To facilitate the insertion and removal of the bar 66 in the frame 69 a spring bar 78 is coupled to the bar 66. The spring bar 78 will permit compression so that the bar 66 may be easily installed or removed from the frame 69.

The embodiments shown in FIGS. 1, 2, 3, 17, 18, 19 and 20 also illustrate engagement means 65 that is a buckle 79. The buckle 79 is comprised of the bar 66, the upper hook 67, the lower hook 68 and the frame 69. The buckle 79 and the frame 69 should be of a material of suitable strength such as metal and may be hand made or cast or by other conventional method.

The invention herein may be used to fasten a wrist watch to the arm of a person or to the leg of a person or other parts of the body. In the embodiment to be used as a wrist watch band the strap 11 has a first slot 22 having a height 26 and a second slot 23 and further comprises a pliable band 80 having a hole 83 and a varying height 84 and a first portion 85 of a snap coupled to the strap 11 and a second portion 86 of a snap coupled to the band 80 wherein the band 80 is inserted in the first slot 22 of the strap 11 and the second slot 23 of the strap 11 so that the height 84 of the band 80 in the first slot 22 is greater than the height 26 of the first slot 22 as shown in FIGS. 1, 15 and 16. It is preferred that the strap 11 have a third slot 24 and a fourth slot 25 as shown in FIG. 1 and that there be two bands 80 for the reason that most watches have two places for attaching the watches to a wrist watch band. Most watches have two openings on either side of the watch and the watch may be fastened to the adjustable fastener 10 by inserting the first portion 81 of the band 80 into the opening of the watch, not shown, then placing the first portion 81 of the band 80 over the first portion 85 of the snap so that the first portion 85 of the snap is inserted in the hole 83 of the band 80 and then the first portion 85 of the snap is mated to the second portion 86 of the snap. The band 80 should be pliable and have a varying height 84 so that when the first portion 81 of the band 80 is inserted in the second slot 23 of the strap 11 and then in the first slot 22 of the strap 11 as shown in FIG. 15 the height 84 of the band 80 will eventually increase to the point where it is greater than the height 26 of the first slot 22 of the strap and perhaps even be greater than the height 27 of the second slot 23 of the strap so that substantial friction will be generated if any attempt is made to pull the band 80 back through the first slot 22 and perhaps even the second slot 23 of the strap 11. Such friction will virtually preclude the band 80 from being accidently removed from the strap 11. It is preferred that the first portion 81 of the band 80 be inserted in any opening of a watch so that when the band 80 is inserted in the first slot 22 and second slot 23 the watch will be between the strap 11 and the second portion 86 of the snap. The height 87 of the second portion 86 of the snap should be of such distance that the watch will not be removeable over the second portion 86 of the snap thereby in substance virtually locking the watch between the second portion 86 of the snap and the front side 12 of the strap 11. This will avoid losing the watch.

The adjustable fastener 10 may be used as a wrist watch band or as a belt. In both of these embodiments it is desireable that an adjustable keeper 88 be on the first portion 14 of the strap 11 as shown in FIG. 1 and 2 so that when the first portion 14 and the second portion 15 of the strap 11 are connected as shown in FIG. 2 the second portion 15 of the strap 11 may be secured so that it does not protrude out as shown in FIGS. 2 and 3.

A feature of the adjustable fastener 10 is that the strap 11 can be cut and the yoke 32 repositioned. This is accomplished by having a plurality of holes 17 in the first portion 14 of the strap 11 positioned in a row as shown in FIG. 1 and 4. Vertical lines 18 are placed on the strap 11 at a plurality of holes 17 on the first portion 14 of the strap 11 to facilitate cutting the strap 11 to provide for the adjustable feature of the adjustable fastener 10. This will enable placing the yoke 32 at a variety of positions on the strap 11. To provide for easy means of connecting the first portion 14 and second portion 15 of the strap 11 to each other a hook 43 is coupled to the yoke 32 as shown in FIGS. 1, 5, 6, 12 and 13. It is preferred that an upper hook 44 be coupled to the yoke 32 and a lower hook 45 be coupled to the yoke 32 as shown in FIGS. 1, 5, 12, 13 and 14. This will provide for a more rigid connection of the first portion 14 of the strap 11 to the second portion 15 of the strap 11. It will also facilitate the making of the clasp portion 42 of the yoke 32 as shown in FIG. 13 since two portions of the yoke 32 can be bent in one direction to form the hook portion 39 of the yoke, that is, an upper hook portion 40 and lower hook portion 41 of the yoke 32 and the area in between can be bent in the other direction to form the clasp portion 42 of the yoke 32. As shown in FIG. 1, 3, 5, 6, 10, 11, 12, 13 and 14 the yoke 32 has a hole 35 and a hook portion 39 that is shaped like a hook and removeable fastening means 47 inserted in a hole 17 in the first portion 14 of the strap 11 and in the hole 35 of the yoke 32. A variety of items could be used as the fastening means 37, such as a rod, nail, bar or rivet. However, none of the foregoing would make the fastening means 47 easily removeable and at the same time securely fasten the yoke 32 to the strap 11. A screw 48 could be used as fastening means 47 as shown in FIG. 11 but it has disadvantages. The screw 48 could be screwed into the yoke 32 if the hole 35 of the yoke 32 was of the appropriate size. However, it is preferred that the fastening means 47 be a stud 49 as shown in FIGS. 1. 2, 3, 6, 8, 9 and 10.

The adjustable fastener 10 is more readily adjusted if the strap 11 has a first end 19 in the first portion 14 of the strap 11 and the yoke 32 mates with the first end 19 of the strap 11 as shown in FIGS. 1, 4 and 5. By having the yoke 32 mate with the first end 19 of the strap 11 the yoke 32 will always be in proper alignment with the strap 11.

The stud 49 has more than one use. It secures the yoke 32 to the strap 11 and also secures the first portion 14 of the strap 11 to the second portion 15 of the strap 11 when the first portion 14 is connected to the second portion 15. This is accomplished by making the stud 49 so that the cross section 52 of the stud decreases towards the top 50 of the stud 49. This results in an appearance very similar to the ball used in trailers on cars. This shape will permit the stud 49 to be easily inserted in various holes and to resist separation of the various parts once the stud 49 is so inserted. To secure the stud 49 in place the stud 49 has a recess 55 and a lock retainer 59 is inserted in the recess 55 of the stud 49 and the lock retainer 59 may also be removed once so inserted as shown in FIGS. 1, 5, 8, 9 and 10.

The hooks 44 and 45 coupled to the yoke 32 would be uncomfortable if the adjustable fastener 10 is being used as a wrist watch band or as a belt to support pants. The hooks 44 and 45 would press into the body of the person wearing the adjustable fastener. This is remedied by having a pad 60 having a hole 63 wherein the stud 49 is inserted in the hole 63 of the pad 60 and in a hole 17 in the first portion 14 of the strap 11 and in the hole 35 of the yoke 32. In a preferred embodiment the pad 60 has a slot 64 and the yoke 32 has a clasp portion 42 shaped like a clasp and the clasp portion 42 of the yoke 32 is inserted in the slot 64 of the pad 60. The pad 60 is positioned behind the hook portion 39 of the yoke 32. The pad is shown in FIGS. 1. 2, 3, 5, 6, 7 and portions of the pad 60 are shown in FIGS. 10 and 11. The upper hook portion 40 and the lower hook portion 41 of the yoke 32 are on the front side 62 of the pad 60 as shown in FIGS. 1 and 5. It is preferred that the stud 49 have a lip 57 at the bottom 51 of the stud 49 as shown in FIGS. 6, 8, 9 and 10. Thus when the stud 49 is inserted in the hole 63 of the pad 60 and the hole 17 in the first portion 14 of the strap 11 and in the hole 35 of the yoke 32 the lip 57 of the stud 49 will make contact with the back side 61 of the pad 60 thereby preventing the stud 49 from moving once the lock retainer 59 is in place as shown in FIG. 10. The stud 49 may be more easily installed and removed as shown in FIG. 10 where the stud has an axis 54 and the stud 49 is disposed about the axis 54 of the stud 49 and the stud 49 has an upper portion 58 that has a curved surface 53. The curved surface 53 of the stud 49 facilitates the insertion of the stud 49 through the holes 63 and 17 and 35 of the pad 60, first portion 14 of the strap 11 and the yoke 32 as shwon in FIG. 10.

In a preferred embodiment the second portion 15 of the strap 11 has a plurality of holes 16 positioned in a middle row and the stud 49 has a groove 56 between the top 50 of the stud 49 and the recess 55 of the stud 49 so that when the first portion 14 of the strap 11 is connected to the second portion 15 of the strap 11 the stud 49 may be removeably inserted in a hole 16 in the middle row of the second portion 15 of the strap 11 as shown in FIGS. 1, 2 and 20. This will further secure the first portion 14 of the strap 11 to the second portion 15 of the strap 11 when the first portion 14 is connected to the second portion 15 of the strap. Small cuts 31 are made at the holes 29 in the middle row of the second portion 15 of the strap 11 to make it more easy to insert the stud 49 in the holes 29 in the middle row of the second portion 15 of the strap 11. It is preferred that the holes 29 in the middle row of the second portion 15 of the strap 11 be approximately positioned midway between the holes 28 in the upper row of the second portion 15 of the strap 11 and the holes 30 in the lower row of the second portion 15 of the strap 11 and midway between adjacent holes 28 in the upper row of the second portion 15 of the strap 11.

As shown in FIGS. 1 and 4 it is preferred that the strap 11 have a top 20 and a bottom 21 that are approximately perpendicular to the first end 19 of the strap 11 and that the top 20 and the bottom 21 of the strap 11 be straight and that the first end 19 of the strap 11 also be straight so that the yoke 32 will easily mate with the first end 19 of the strap 11 even when the first portion 14 of the strap 11 is shortened by cutting along the lines 18 in the first portion 14 of the strap 11.

In another preferred embodiment the yoke 32 has a top lip 36 that is coupled to the top 20 of the strap 11 and a bottom lip 37 that is coupled to the bottom 21 of the strap 11 and a side lip 38 that is coupled to the first end 19 of the strap 11 as shown in FIGS. 1, 3, 12, 13 and 14. The top lip 36 of the yoke 32 makes contact with the top 20 of the strap 11 and the bottom lip 37 of the yoke 32 makes contact with the bottom 21 of the strap 11 thereby preventing the yoke 32 from rotating about the axis 54 of the stud 49 or from moving up or down. The side lip 38 of the yoke 32 makes contact with the first end 19 of the strap 11 and also helps to prevent movement of the yoke 32.

In the embodiment shown in FIGS. 1 through 10, 12, 13, 14 and 17 through 23 an adjustable fastener 10 is shown comprising a strap 11 having a second portion 15 and a first portion 14 having a plurality of holes 17 in a row in the first portion 14 of the strap 11 and having approximately straight first end 19, top 20 and bottom 21 in the first portion 14 of the strap 11 wherein the first end 19 of the strap 11 is approximately perpendicular to the top 20 and the bottom 21 of the strap 11 and a yoke 32 having a hole 35 adjustably coupled to the first portion 14 of the strap 11 and having a hook portion 39 of the yoke 32 that is shaped like a hook and having a clasp portion 42 of the yoke 32 that is shaped like a clasp and having a top lip 36 coupled to the top 20 of the strap 11 and a bottom lip 37 coupled to the bottom 21 of the strap 11 and a side lip 38 coupled to the first end 19 of the first portion 14 of the strap 11 and a stud 49 having an axis 54 and the stud 49 is disposed about the axis 54 of the stud 49 and having an upper portion 58 that has a curved surface 53 and having a top 50 and a bottom 51 and a lip 57 at the bottom 51 of the stud 49 and having a recess 55 and a pad 60 having a hole 63 and a slot 64 wherein the clasp portion 42 of the yoke 32 is inserted in the slot 64 of the pad 60 and the stud 49 is inserted in the hole 63 of the pad 60 and the hole 17 in the first portion 14 of the strap 11 and the hole 35 of the yoke 32 and a lock retainer 59 is coupled to the recess 55 of the stud 49 and a bar 66 is coupled to the second portion 15 of the strap 11.

Two possible uses of the adjustable fastener 10 are as wrist watch bands or as a belt for the pants of a person. In such applications the strap 11 may be made of plastic, vinyl, cloth, leather or any other suitable material. The keeper 88 and the pad 60 may be made of the same materials that the strap 11 is made of. The keeper 88 may be one strip of material that is wrapped around the strap 11 and then fastened together so that the keeper 88 may be moved along the strap 11 in order to accommodate different size straps 11.

Although a clasp 46 may be coupled to the yoke 32 it is preferred that the clasp 46 be formed from the yoke 32 so that a clasp portion 42 of the yoke 32 is shaped like a clasp. The yoke 32 then may be one piece as shown in FIGS. 12, 13 and 14. The yoke should be made of a material of sufficient strength such as a metal or plastic and the yoke 32 may be made from stainless steel or a more ornamental material such as new gold which is a trademark. The yoke 32 may be made by a stamping process or by a mold or may be hand made. The front side 33 and the back side 34 of the yoke 32 should both be flat so that the yoke 32 will sit flat against the strap 11. The yoke 32 is situated on the front side 12 of the strap 11 since in most cases the back side 13 of the strap 11 would be against the part of the body of the person that the adjustable fastener 10 is being used on. One method of coupling the yoke 32 to the strap 11 is to first insert the clasp portion 42 of the yoke 32 in the slot 64 of the pad 60 and align the hole 35 of the yoke 32 with the hole 63 of the pad 60 and then place the front side 62 of the pad 60 against the back side 13 of the strap and place the back side 34 of the yoke 32 against the front side 12 of the strap 11 and then align the hole 17 in the first portion 14 of the strap 11 with the hole 35 of the yoke 32 and the hole 63 of the pad 60. Once these holes 35, 63 and 17 are aligned the stud 49 is inserted from the back side 61 of the pad 60 through the holes 63, 35 and 17 until the lip 57 of the stud 49 makes contact with the back side 61 of the pad 60 and the recess 55 of the stud 49 is above the front side 33 of the yoke 32 as shown in FIG. 10 at which time the lock retainer 59 may be inserted into the recess 55 of the stud 49. The stud 49 and the lock retainer 59 should be made of a material of sufficient strength and most metals would be suitable. The lock retainer 59 may be purchased as a ready made part. The stud 49 may be made by hand or by a stamping process or by molding or other conventional methods.

The invention herein is a distinct advancement over the prior art in that only one size adjustable fastener 10 need be stocked for use as a belt and the strap 11 may be cut along the lines 18 in order to make the adjustable fastener the correct size. This eliminates the need to have a variety of sizes. The adjustable fastener 10 may be quickly adjusted to virtually any size. This is also an advancement in the manufacturing process because only one size strap 11 need be made. The yoke 32 with the stud 49 used as the fastening means 47 eliminates the necessity of riveting the yoke 32 to the strap 11. The same is true when the adjustable fastener 10 is used in the embodiment of a watch band. Because both the buckle 79 and the yoke 32 may be moved the exact desired size of the strap 11 may be obtained without resulting in an unduly long second portion 15 of the strap 11. The invention herein also eliminates the need to do any sewing in order to position the yoke 32. The invention herein thus is a substantial improvement over the prior art.

It is to be understood that the invention is not limited to the exact details of construction, operation or exact materials or embodiments shown and described, as obvious modifications and equivalents will be apparent to one skilled in the art, and the invention is therefore to be limited only by the scope of the appended claims.

What is claimed is:

1. An adjustable fastener, comprising:

a strap having a second portion and a first portion having a plurality of holes in a row in the first portion of the strap and having an approximately straight first end, top and bottom in the first portion of the strap wherein the first end of the strap is approximately perpendicular to the top and the bottom of the strap;

a yoke having a hole adjustably coupled to the first portion of the strap and having a hook portion of the yoke that is shaped like a hook and having a clasp portion of the yoke that is shaped like a clasp and having a top lip coupled to the top of the strap and a bottom lip coupled to the bottom of the strap and a side lip coupled to the first end of the first portion of the strap;

a stud having an axis and the stud is disposed about the axis of the stud and having an upper portion that has a curved surface and having a top and a bottom and a lip at the bottom of the stud and having a recess;

a pad having a hole and a slot wherein the clasp portion of the yoke is inserted in the slot of the pad and the stud is inserted in the hole of the pad and the hole of the strap and the hole of the yoke;

a lock retainer is coupled to the recess of the stud; and a bar is coupled to the second portion of the strap.

2. An adjustable fastener, comprising:

a strap having a first portion and a second portion and a plurality of holes positioned in a row in the first portion of the strap;

a yoke having a hole and a hook portion that is shaped like a hook and a clasp portion shaped like a clasp wherein the yoke is adjustably coupled to the first portion of the strap;

a stud having a cross section and a top wherein the cross section of the stud decreases towards the top of the stud;

a pad having a hole and a slot wherein the stud is inserted in the hole of the pad and in a hole in the first portion of the strap and in the hole of the yoke and the clasp portion of the yoke is inserted in the slot of the pad.

3. The invention as claimed in claim 2 wherein the pad is positioned behind the hook portion of the yoke.

* * * * *